US006040514A

United States Patent [19]

Liao

[11] Patent Number: 6,040,514

[45] Date of Patent: Mar. 21, 2000

[54] LEGLESS CONGA DRUM STAND FOR USE WHILE SITTING OR KNEELING

[75] Inventor: Tsun-Chi Liao, Taichung, Taiwan

[73] Assignee: HWA Shin Musical Instrument Co., Ltd., Taichung, Taiwan

[21] Appl. No.: 09/072,684

[22] Filed: May 6, 1998

[51] Int. Cl.[7] ..... G10D 13/02

[52] U.S. Cl. ..... 84/421; 248/127; 248/315; 248/346.07

[58] Field of Search ..... 84/421, 411 R, 84/327, 453; 248/127, 435, 436, 315, 346.07

[56] References Cited

U.S. PATENT DOCUMENTS

| | | | |
|---|---|---|---|
| 624,662 | 5/1899 | Leedy | 84/421 |
| 751,880 | 2/1904 | Stevenson | 84/267 |
| 1,021,328 | 3/1912 | Noll | 248/315 |
| 1,059,192 | 4/1913 | Mills | 84/421 |
| 1,652,774 | 12/1927 | Fraser et al. | 108/92 |
| 1,684,925 | 9/1928 | Perlmutter | 248/346.07 |
| 1,750,803 | 3/1930 | Hayden | 248/356 |
| 1,762,645 | 6/1930 | Spalleno | 84/453 |
| 2,250,361 | 7/1941 | Cullinan | 248/346.07 |
| 2,433,594 | 12/1947 | Calo | 84/421 |
| 2,665,872 | 1/1954 | De Witt | 248/346.07 |
| 2,861,767 | 11/1958 | Oves et al. | 248/356 |
| 3,405,588 | 10/1968 | Della-Porta | 84/421 |
| 3,439,573 | 4/1969 | Zottolo | 84/411 |
| 4,829,874 | 5/1989 | Hoshino | 84/421 |
| 5,335,575 | 8/1994 | Hoshino | 84/421 |
| 5,467,680 | 11/1995 | Kurosaki | 84/421 |
| 5,520,292 | 5/1996 | Lombardi | 211/13 |
| 5,551,660 | 9/1996 | Leduchowski | 248/276.1 |
| 5,739,449 | 4/1998 | Torres, Jr. | 84/421 |

FOREIGN PATENT DOCUMENTS

| | | |
|---|---|---|
| 2585846A | 5/1986 | France . |
| 4243499 | 3/1994 | Germany . |
| 610151 | 10/1948 | United Kingdom . |

OTHER PUBLICATIONS

Latin Percussion Inc. Catalog, pp. 5 and 10, Jan. 1975.
Carroll Sound's Gallery of Sound Catalog, p. 13, Apr. 1980.

*Primary Examiner*—Robert E. Nappi
*Assistant Examiner*—Wesley Scott Ashton
*Attorney, Agent, or Firm*—Bacon & Thomas

[57] ABSTRACT

A structural improvement for a conga drum stand including a ring-framed carrier having a round hole at its center and a number of balancing blocks extending radially from its rim with a hole extending between the trough and the channel of each balancing block. A positioning block, inserted into each of the troughs, includes a vertical locking hole in the bock base. The locking hole is penetrated by a locking component with a hexagonal nut at its bottom end in the channel. The positioning blocks are configured so that they can be easily positioned in the trough.

4 Claims, 7 Drawing Sheets

LEGLESS CONGA DRUM STAND FOR USE WHILE SITTING OR KNEELING

BACKGROUND OF THE INVENTION

The prevent invention relates to a drum stand, or more specifically, to a stand for a conga drum, with such characteristics as convenient adjustment to suit the different sizes of the drums, to reduce the height of the integral drum unit and to ensure steady assembly of the drum unit.

Conga drum stands come in all shapes and types, each conga drum of different shape may need a different drum stand; the subject under discussion relates to a stand for conga drum that is shaped as an elongated cylinder.

Please refer to FIG. 1 that is a perspective view of a prior art of conga drum stand; said conga drum stand comprises a fixing ring with specified measurements, the bottom of said fixing, ring having several legs that are composed of straight rods, on the inside rim of the fixing, ring being several thin-plated supporters; the bottom rim of said conga drum is placed inside said fixing ring, while the several supporters serve to support the batter head of the conga drum. The fixing ring for such a type of conga drum has specified measurements that will accommodate only one size of conga drum, while the conga drums with different sizes shall need the drum stands of other measurements, the result is that the drum stand could not be adjusted to suit the conga drums of other measurements, so the compatibility of the drum with the stand is reduced; furthermore, since said prior art of drum stand is not collapsible, it will occupy much space when it is not in use.

Please refer to FIGS. 2 which shows a perspective view of a another prior art of conga drum stand; it comprises a fixing ring, on its rim being several adjustable supporters; below the fixing ring is a leg unit, and near the center of each leg being a crosswise connecting rod that extends inward and is connected to a connector; the bottom section of said conga drum is positioned within the fixing ring, and supported by said supporters. Such a type of conga drum stand has an advantage over the first prior art of conga drum stand in that it involves the adjustable supporters to suit different sizes of drum diameters.

Said two types of conga drum stands are designed for performers to batter the drumhead in a standing position. No drum stand is needed in case the performer wishes to sit on an easy chair, in that case, the drum is positioned directly on the floor, while the performer uses his both legs to secure the conga drum at an inclined angle so that its bottom side will not be fully in contact with the floor surface, and the drum sound will be transmitted fully without suffocation; but a performer will find such a position inconvenient, if there is another type of conga drum stand that will enable the performer to batter the drumhead while he is sitting on an easy chair, the performer will certainly be delighted to take the option.

SUMMARY OF THE INVENTION

The primary objective of the present invention is to present a structural improvement of conga drum stand, said conga drum stand having the effect of free, step-less sliding adjustment to suit the secure positioning of different sizes of conga drums; it is easily and quickly assembled; it will not occupy much space because it can be collapsed for storage, and its light weight will facilitate convenient transportation.

Another objective of the prevent invention is to present a structural improvement of conga drum stand, the height of said conga drum stand can be reduced so that the performer will be able to sit on an easy to batter the drumhead, while his two legs will not have to hold the conga drum, and the performer may feel more comfortable.

The technical approach adopted to achieve said objectives of the present invention:

A ring-framed carrier, at its center being a round hole, extending on its rim being several balancing blocks, on its top being an open trough, on its bottom recessed upward being a long channel; on the bottom of said open trough being a long hole that communicates to said long channel; several positioning blocks with their block bases inserted in said open troughs, running vertically on said block base being a locking hole, a locking component penetrating said base and extending to the long channel and being tightened by a hexagonal nut, to fix said positioning block; so configured that each of said positioning blocks may be sliding in said open trough for step-less adjustment.

DETAILED DESCRIPTION OF PREFERRED EMBODIMENT

Figure 1:
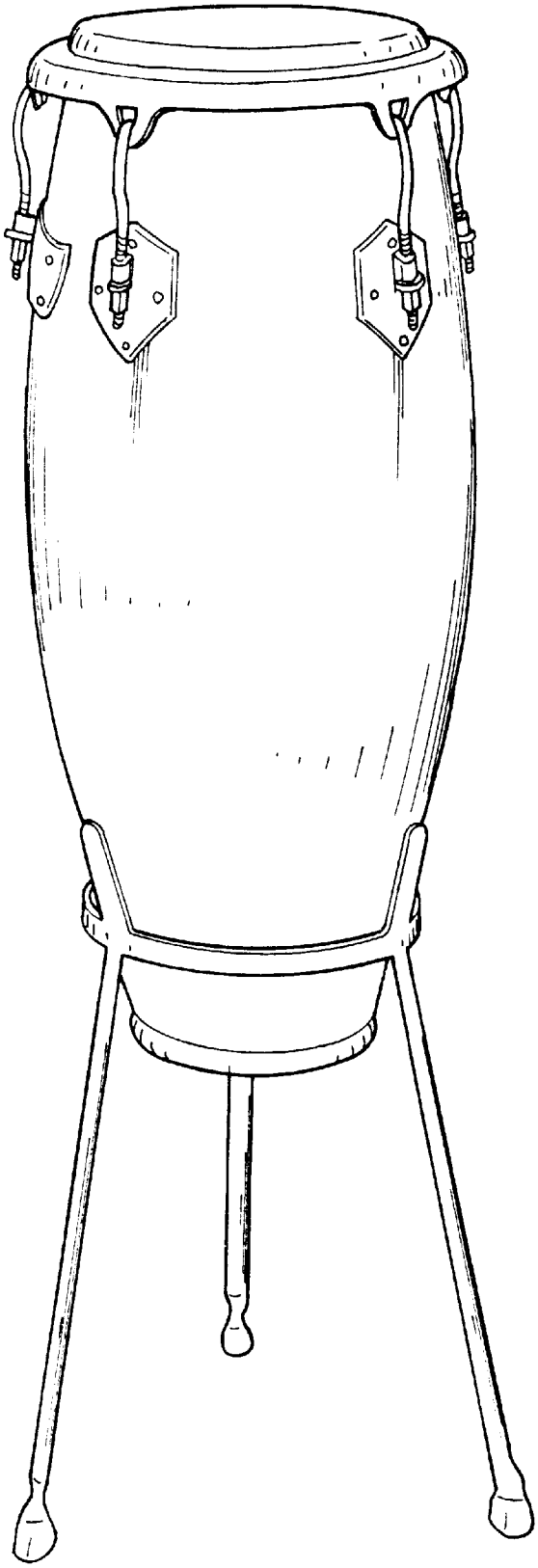
Fig·1 PRIOR ART
FIG. 1 is a perspective assembled view of a prior art of conga drum stand.
Figure 2:
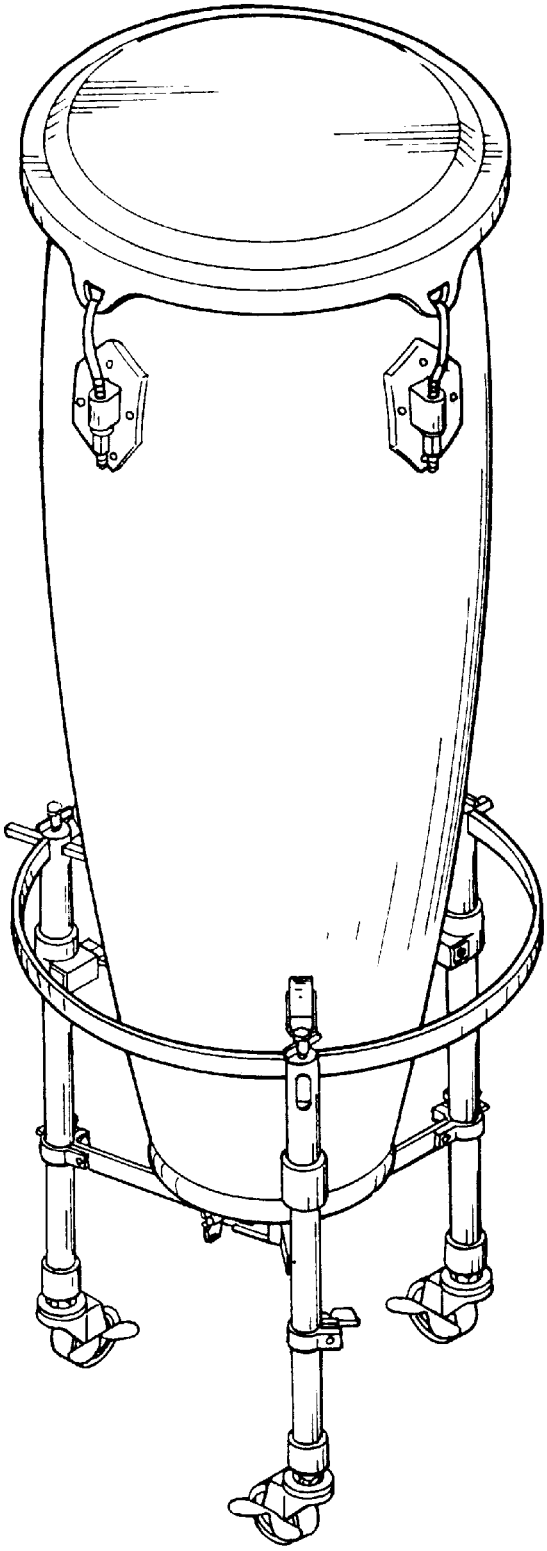
Fig·2 PRIOR ART
FIG. 2 is a perspective assembled view of another prior art of conga drum stand.
Figure 3:
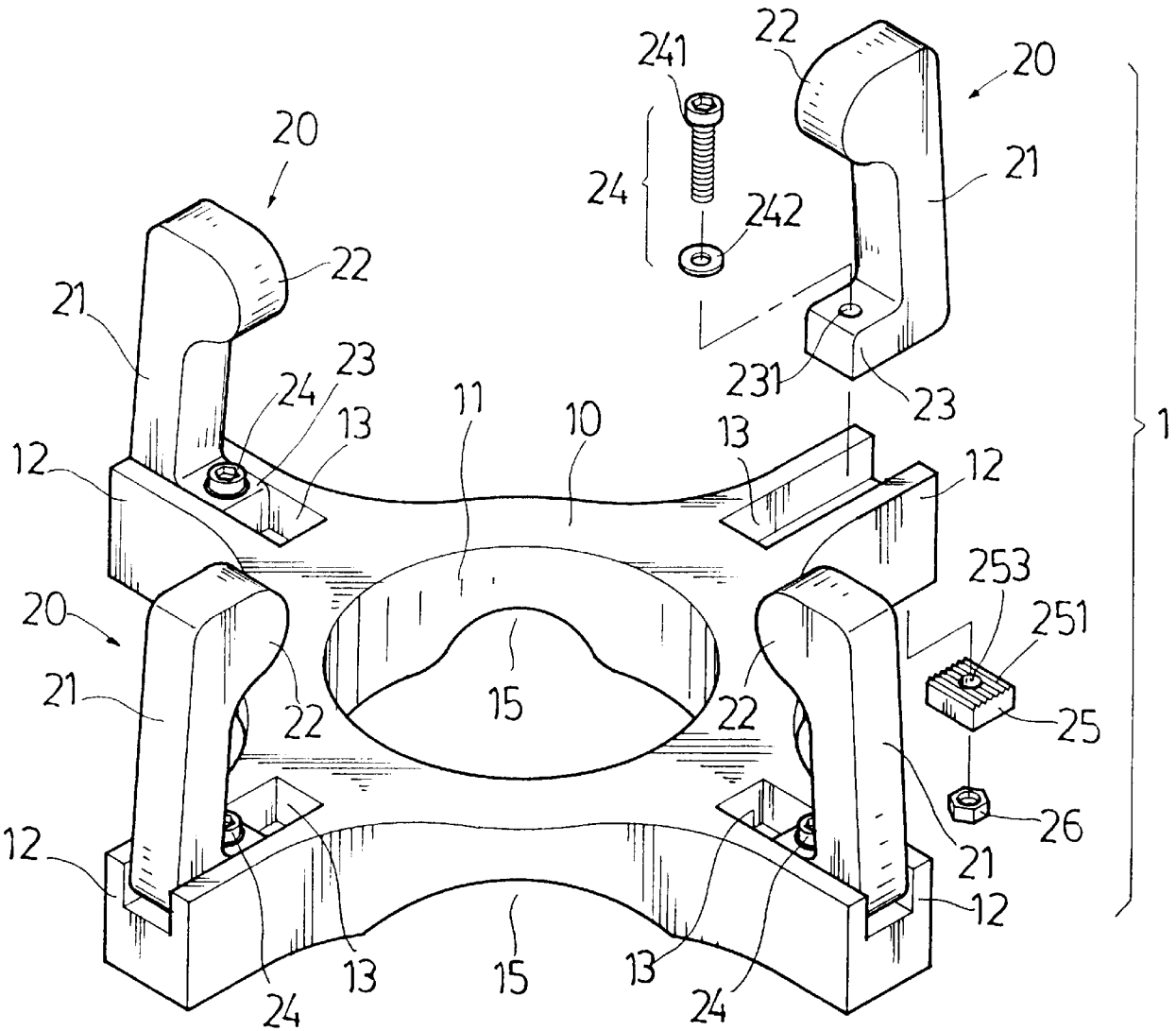
FIG. 3 is an exploded view of the invention.
Figure 4:
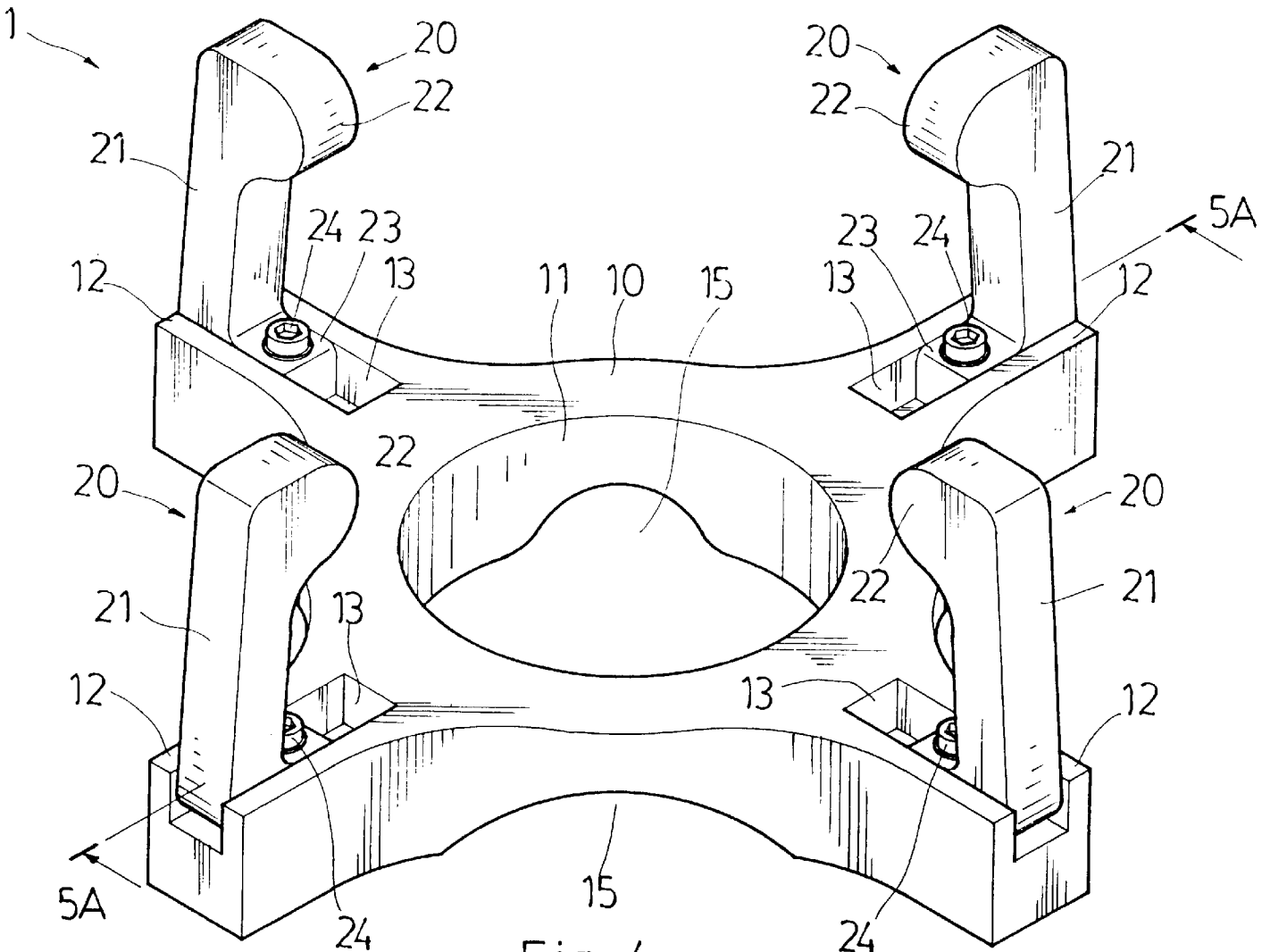
FIG. 4 is perspective assembled view of the invention
Figure 5A:
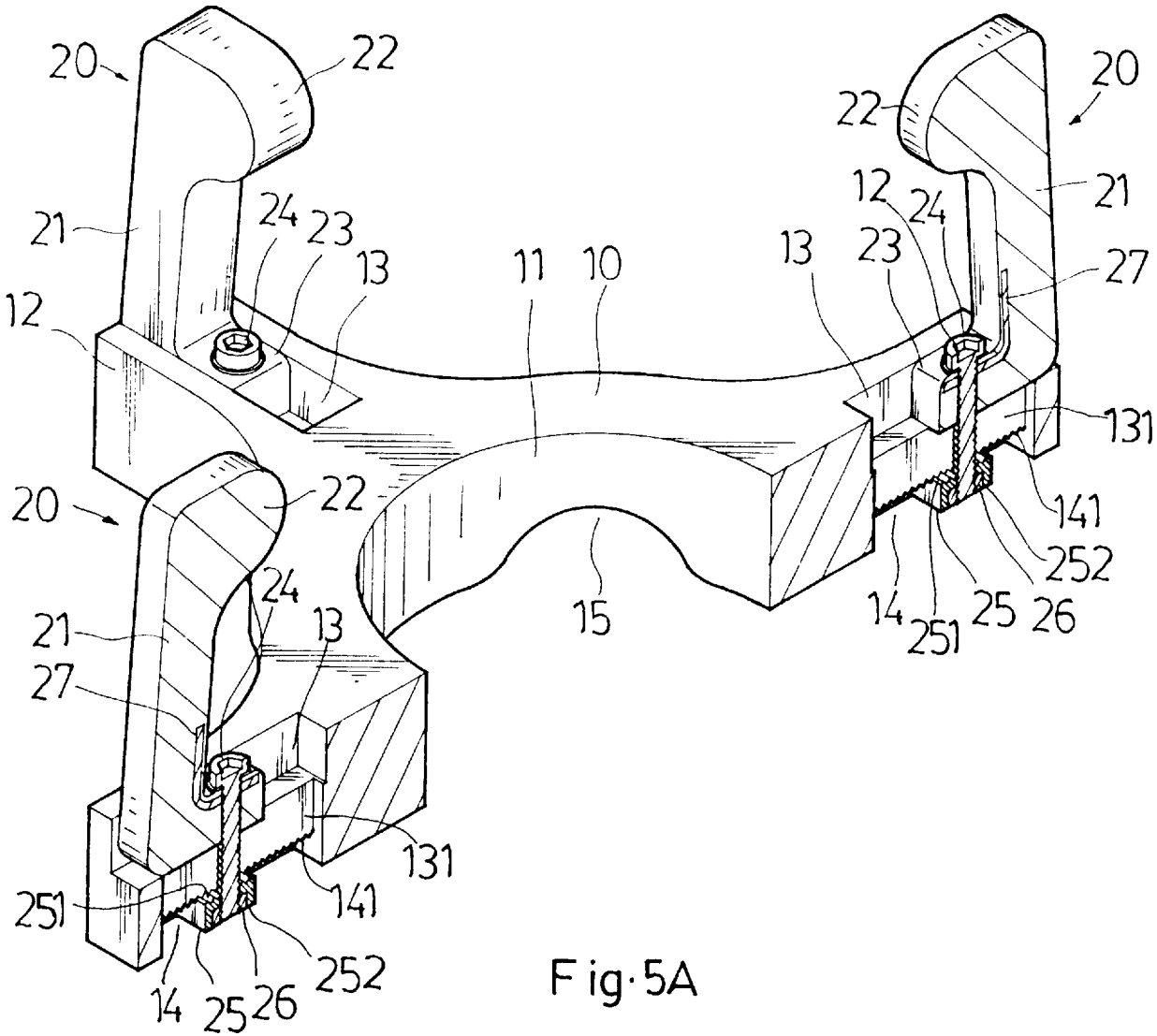
FIG. 5A is a perspective sectioned view of 5A—5A in FIG. 4.

Please refer to FIGS. 3 to 5A: the present invention of conga drum stand 1 comprises mainly:

a carrier 10, shaped roughly like a ring, framework, at its center is a round hole 11, projecting outward from the rim of said carrier 10 being the formation of several balancing blocks 12, on the top of each balancing block 12 being an open trough 13, on the bottom of each balancing block 12 corresponding to said open trough 13 being a long channel 14 that is recessed to the upside; on the bottom of said open trough 13 being a long hole 131 that communicates to said long channel 14, and the top side of said long channel 14 being a toothed side 141; on the surrounding wall of said round hole and between every two balancing blocks being an arched sound escape arc 15;

a same number of positioning blocks 20 as said open troughs 13, with the same width as said open troughs 13, each of said positioning blocks 20 having an erected block body 21, on top of said block body 21 projecting to the side being an arched block end 22, at the bottom of said block body 21 and projecting to the same side as said block end 22 being the formation of a flat-bottomed block base 23, on said block base 23 and running in vertical direction being a locking hole 231; said block end 22 being somewhat inclined to said block body 21 and connected with said horizontal block base 23; the block base 23 of each of said positioning blocks 20 being inserted inside said open trough 13, said block body 21 and block end 22 thus being erected on top of said carrier 10, and each block body 21 being slightly inclined to the center of the carrier 10, each block end 22 facing the center of the carrier 10; to the locking hole 231 of said block base 23 being inserted a locking component 24 (the locking component 24 in the prevent invention being a long bolt 241 and a washer 242);

a number of slide blocks 25 located inside said long channels 14, the top side of said slide block 25 being a ribbed side 251 that can be toothed with the ribbed side 141 of said long channel 14; on the bottom of said slide block 25 being an angle trough 252 to which being inserted a hexagonal nut 26, at the center of said slide block 25 running vertically being a through hole 253 that communicates to said angle trough 252, so said locking component 24 penetrates the lower section of said long hole 131 and extends into the through hole 253 of said slide block 25, which is tightened with the hexagonal nut 26, to press said slide block 25 tightly against the ribbed side 141 of said long channel 14, so that said positioning block 20 can be securely fixed and positioned in said open trough 13;

in said configuration, each of said positioning blocks 20 may be sliding freely in the long hole 131 of said open trough 13, to change the space and diameter encompassed by the block ends 22, to suit various sizes of conga drum.

Furthermore, said positioning blocks 20 are made of plastic materials, with L-shaped metal reinforcing pieces 27 fitted to the inside comers between said block body 21 and block base 23, the outside of said reinforcing piece 27 is then covered with plastic materials in the shape of said positioning block 20, so the metal reinforcing plates serve to increase its structural strength.

Figure 6A:
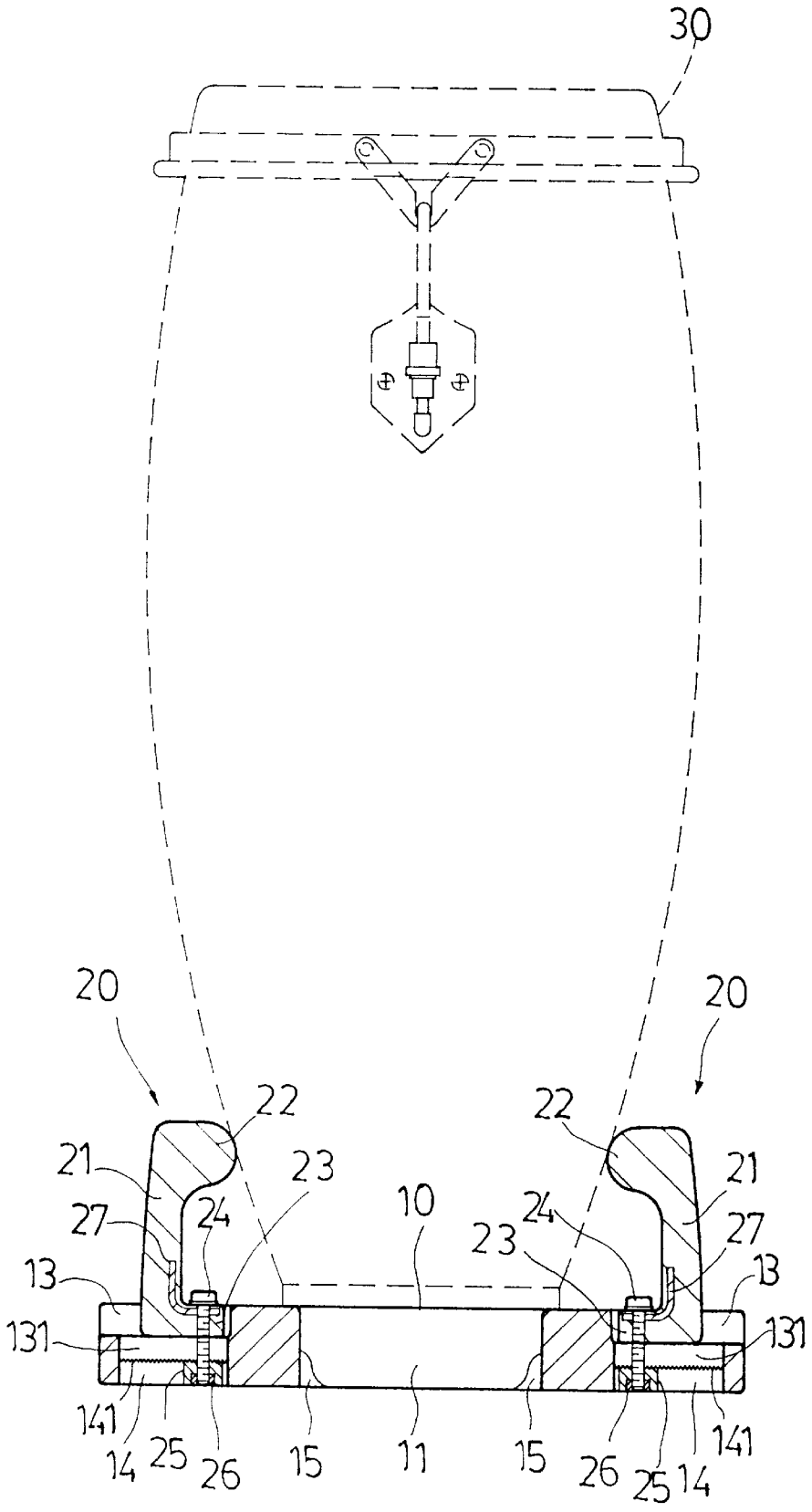
FIG. 6A is a partially sectional view of the invention of conga drum stand (1).
Figure 6B:
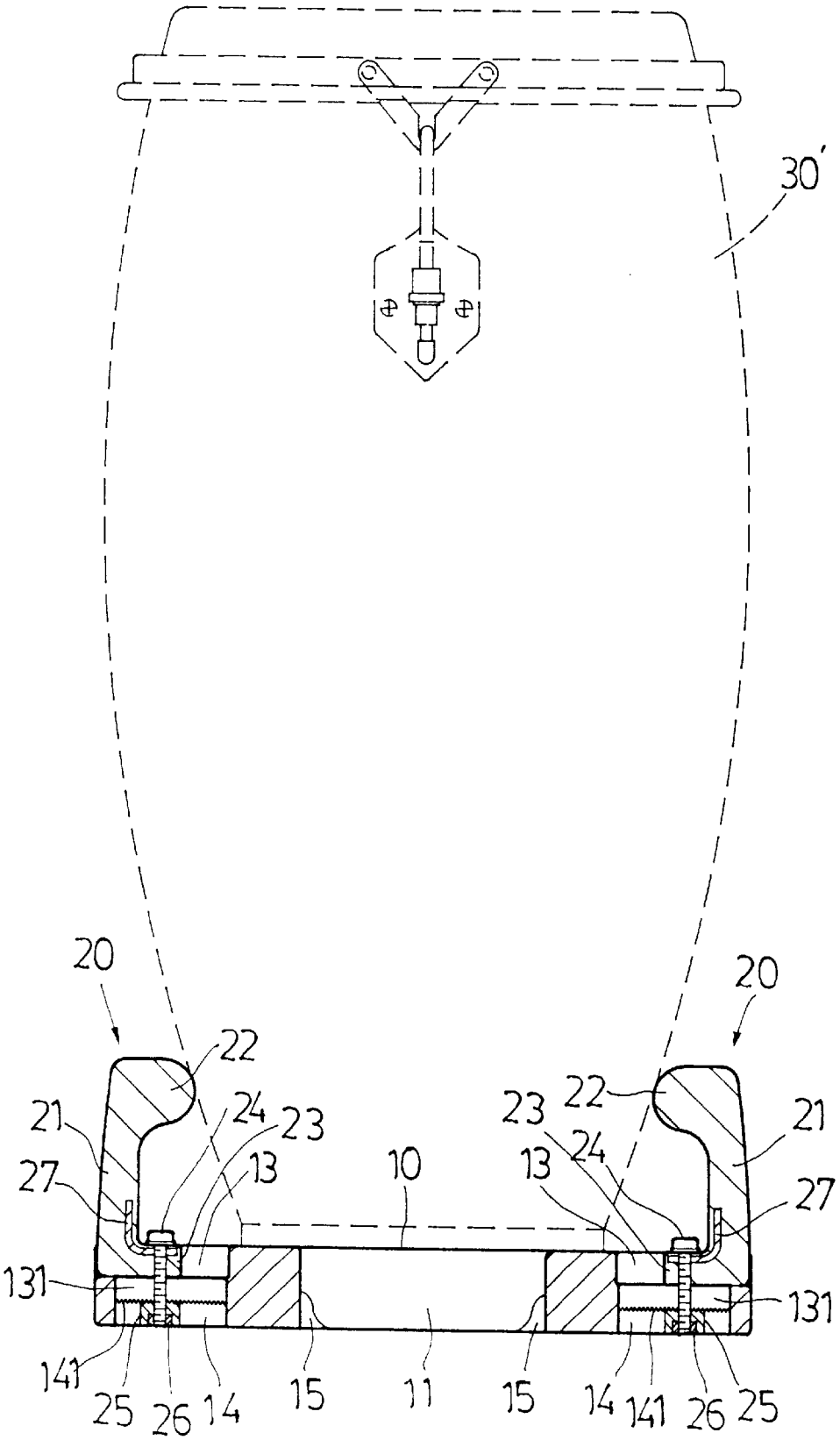
FIG. 6B is a partially sectional view of the invention of conga drum stand (2).

Please refer to FIGS. 6A and 6B;

When said carrier 10 is put on the floor, the bottom of the conga drum 30 or 30' can then be carried on the top of said carrier 10, then according to the size and diameter of said conga drum 30 or 30', said positioning blocks 20 are adjusted freely, in case of a drum with a larger diameter, said positioning blocks 20 are moved outwards in the open troughs 13, so the block ends 22 of said positioning blocks 20 form a surrounded area of an appropriate size to accommodate said conga drum 30 or 30', with the block ends 22 squeezing onto the outside of the drum to position it.

The present invention has the following features:

A. The positioning blocks 20 may be moved and adjusted freely inside said open troughs 13, to enable the accommodation of any size of the conga drum 30 or 30'.

B. The subject conga drum stand 1 is put on the floor, at a height much lower than that for said prior art so the performer will be able to sit on an easy chair to batter the head of the drum, without having to clamp the conga drum with his feet, and the result is a more comfortable and easy sitting, position.

C. The conga drum 30 or 30' is positioned on top of the carrier 10, while the carrier 10 is put on the floor, so the drum body can be better supported for steady carrying effects, while the side wall is positioned by said positioning blocks 20 to prevent inclination; meanwhile, said positioning blocks 20 serve to contribute to the positioning of the drum body on the sides of the drum, the positioning blocks 20 not so tightly pressed to the drum sides as to scratch the lacquer coating, so the outside painting of the drum can be kept intact and beautiful.

D. In case the drum stand 1 is placed on the floor, the drum sound will be efficiently transmitted, since the drum sound can be transmitted to the round hole 11 of the carrier 10 and resonance can be maintained, and since the drum sound can be transmitted out of the sound escape arcs 15, it will not sound suffocated.

E. After the subject matter is disassembled, it become a flattened carrier 10 and several flattened positioning blocks 20, so the unit can be stacked and stored any where without occupying much space, and its light weight will facilitate convenient portability and transportation.

F. When the conga drum set is placed on the subject conga drum stand 1, one single man will be able to perform the job; though the size of batter head of same-model conga drums may vary, since the length of their drum body is the same, therefore, when the conga drum of the same model is placed on the subject conga drum stand 1, the batter heads of several drums will be at a same height, then only the positioning blocks 20 need to be adjusted, so the assembling process is quite convenient and quick, and the number of persons required in the assembling process can be minimized.

What is claimed is:

1. A type of structural improvement of conga drum stand, said conga drum stand comprises mainly:

a carrier, being shaped as a ring frame, at its center being a round hole, extending radially from the rim of said carrier being the formation of several balancing blocks, on top of each of said balancing blocks being an open trough, and on the bottom of each of the balancing blocks being recessed upward a long channel to correspond the positions of said open troughs; on the bottom side of said open trough being a long hole that communicates to said long channel; on the wall of said round hole and between every two balancing blocks being an arched sound escape arc;

a same number of positioning blocks as said open troughs with the same width as the open troughs, each of said positioning blocks having an erected block body, the top of said block body projecting sideways to form a block end, the bottom of said block body projecting toward the same side as said block end being the formation of a block base; running vertically on said block base being a locking hole; the block bases of said positioning blocks being installed in said open troughs, said locking hole being penetrated by a locking component through said long hole, its bottom end extending to the long channel and being tightened by a hexagonal nut to fix said positioning block;

so configured that each positioning block may be moved freely inside said open trough.

2. The structural improvement of conga drum stand, as recited in claim 1, wherein the top of said long channel is a ribbed side; a slide block being located in each of said long channels, the top of said slide block being a ribbed side, to be toothed with the ribbed side on said long channel; on the bottom of said slide block being an angle trough that is inserted in said hexagonal nut, running vertically at the center of said slide block being a through hole that communicates to said angle trough, said locking component penetrating said long hole into the trough hole of said slide block, then tightened with the hexagonal nut, so said slide block presses tightly on the ribbed side of said long channel, to position said positioning block inside said open trough more steadily and securely.

3. The structural improvement of conga drum stand, as recited in claim 1, wherein the block end of said positioning block is inclined to the block body and is joined with said block base, so that after said positioning block is joined to the carrier, said block body and block end incline slightly to the center of the carrier.

4. The structural improvement of conga drum stand, as recited in claim 1, wherein at the inside corner at the connection of said block body and block base inside said positioning block is an L-shaped reinforcing piece to increase its structural strength.

* * * * *